United States Patent [19]

Jacobson et al.

[11] 4,037,503

[45] July 26, 1977

[54] POWER OPERATED GUITAR DEVICE

[76] Inventors: Evan C. Jacobson, 6479 Rendina St., Long Beach, Calif. 90815; Stephen R. Becker, 1525 Freeman Ave., Long Beach, Calif. 90804

[21] Appl. No.: 630,304

[22] Filed: Nov. 10, 1975

Related U.S. Application Data

[63] Continuation-in-part of Ser. No. 500,028, Aug. 23, 1974, abandoned.

[51] Int. Cl.[2] ..... G10F 1/20; G10D 3/16

[52] U.S. Cl. ..... 84/9; 84/267; 84/320; 84/325

[58] Field of Search ..... 84/8–11, 84/267, 315, 320, 325, 326

[56] References Cited

U.S. PATENT DOCUMENTS

| | | | |
|---|---|---|---|
| 1,085,943 | 2/1914 | Sandell | 84/11 |
| 1,457,187 | 5/1923 | Riessner | 84/8 |
| 1,738,257 | 12/1929 | Mills | 84/11 |
| 3,146,657 | 9/1964 | Joslyn | 84/320 |
| 3,290,981 | 12/1964 | Thibodeaux | 84/11 |
| 3,443,468 | 5/1969 | Kidwell | 84/315 |
| 3,603,192 | 9/1971 | Kaar | 84/173 |
| 3,882,754 | 5/1975 | Godley et al. | 84/320 |

FOREIGN PATENT DOCUMENTS

| | | | |
|---|---|---|---|
| 403,153 | 5/1923 | Germany | 84/325 |

*Primary Examiner*—Stephen J. Tomsky
*Attorney, Agent, or Firm*—Fulwider, Patton, Rieber, Lee & Utecht

[57] ABSTRACT

A power operated device that is mounted on a musical stringed instrument such as a guitar to selectively bring one or a desired group of rotating members into light pressure contact with strings of the instrument to cause one or a desired group of strings to vibrate at least so long as the rotatable members are in rotating contact therewith to emit musical tones. The device permits unusual and novel musical effects to be obtained from an instrument due to the strings being subjected to vibration for any desired period of time, in contrast to the short period of time a string vibrates to emit a musical tone when the string is plucked by a finger or with a pick.

18 Claims, 7 Drawing Figures

POWER OPERATED GUITAR DEVICE

REFERENCE TO RELATED APPLICATIONS

This application is a continuation-in-part of our copending application, Ser. No. 500,028, filed Aug. 23, 1974 now abandoned.

BACKGROUND OF THE INVENTION

1. Field of the Invention

This invention relates to musical stringed instruments and, in particular to a power operated device for a guitar and the like.

2. Description of the Prior Art

The present day musical, stringed instrument such as a guitar includes a hollow body having a neck extending therefrom, with laterally spaced tensioned strings being supported in longitudinally extending positions thereon and in pressure contact with a tailpiece. Guitars have fretted necks to serve as a fingerboard. Vibrations of the strings are transmitted from the tailpiece to the top of the body. The top is coupled to the bottom of the body by a post. The top has an opening therein. The top and bottom, the opening, and the hollow interior of the body form a multi-resonant system for coupling the vibrating strings to the air to produce musical tones.

In an electrical guitar the vibrations of the strings are transmitted to a bridge, which bridge in turn transmits the vibrations to a mechano-electric transducer. The transducer converts the mechanical vibrations into corresponding electrical variations. These variations are amplified by suitable electrical means to energize a loud speaker to produce musical tones. In both the conventional guitar and the electrical version thereof the strings are plucked by the fingers or with a pick to cause the strings to vibrate. However, the vibrations of the plucked strings quickly dampen out and the musical tone produced thereby is of short duration.

A major object of the present invention is to provide a manually actuated, power operated device that permits a plurality of rotating members to be brought selectively into light pressure contact with the strings of a musical stringed instrument to cause the latter to vibrate. The strings will vibrate so long as such pressure contact is effected, and as a result novel and unusual musical effects may be achieved from instrument, such as a conventional or electrical guitar, that are not attainable when the strings are plucked.

Other objects of the invention include providing for detachable mounting of the device to guitars, fully adjustable spacing of the device's rotating members to fit guitars with varied string spacing, a keyboard arrangement conforming to the natural finger positions, and dampening of the action of the rotating members.

SUMMARY OF THE INVENTION

A plurality of power driven rollers movably supported on a musical stringed instrument such as a guitar in such a manner that selectively pressing one or a desired group of keys a desired one or group of the rollers may be brought into light pressure contact with the strings to cause the latter to vibrate so long as such contact is maintained. The duration of vibration of each string is determined by the length of time the power driven roller associated therewith is maintained in contact with the string. Due to the duration of the vibration of each string being controllable by the user of the guitar or stringed instrument equipped with the present invention, novel and unusual musical effects may be attained that are not possible by plucking the stringed instrument in a conventional manner.

DESCRIPTION OF THE PREFERRED EMBODIMENTS

Figure 1:
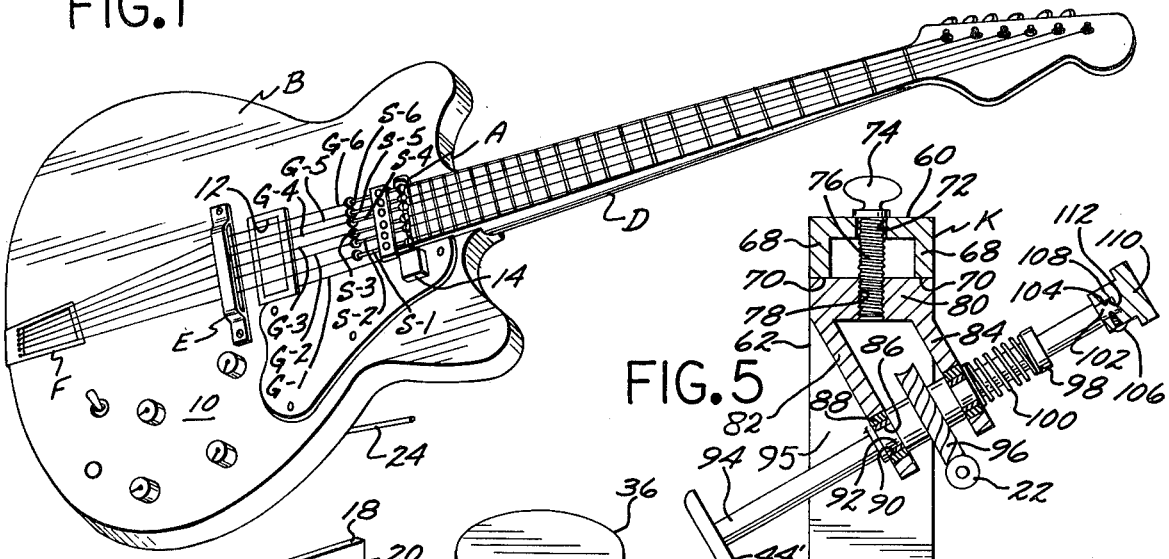
FIG. 1 is a perspective view of a guitar that has the power operated device of the present invention associated therewith.

The invention A is illustrated in the FIG. 1 as mounted on an electrical guitar B. The guitar B includes a body C that has a fretted keyboard D extending outwardly therefrom, as is conventional with such devices. Body C has a first side 10 in which an opening 12 is formed. A bridge E and tailpiece F are mounted on side 10. A number of tensioned strings G-1 to G-6 inclusive have first ends thereof secured to the outer extremity of the keyboard D. The strings G-1 and G-6 extend longitudinally in laterally spaced relationship over the keyboard D and body C to pressure contact bridge E and have second ends of the strings secured to tailpiece F.

The invention A includes a small electric motor 14 that has an elongate base 16 extending therefrom. The base on the end opposite from that of the motor 14 has a bracket 18 extending upwardly therefrom on which a bearing 10 is mounted. An elongate worm gear 22 is driven by motor 14. The end of the worm gear 22 most remote from motor 14 is journalled in bearing 20. The source of electric power for the motor 14 is conventional, such as a battery 14*a* located adjacent thereto on a take-off (not shown) from the power supply used in actuating the guitar. The amplifier and loudspeaker used with the guitar B are conventional and hence not shown in the drawing. The amplifier is connected to the guitar B by a cable 24.

The base 16 is secured to the first side 10 of the guitar body C by conventional fastening means such as an adhesive or the like (not shown). The base 16 is disposed in a transverse position on side 10, and with the worm gear 22 preferably located above the strings G-1 to G-6.

An inverted channel-shaped body 24 is longitudinally spaced from base 16 and extends transversely relative to the strings G-1 to G-6. Body 24 includes an elongate web 26 disposed a substantial distance above strings G-1 to G-6 that has two downwardly extending legs 28 at the ends thereof. The legs 28 on their lower ends develop into aligned tabs 30 that are secured to the side 10 by conventional means such as an adhesive or the like (not shown). Body 24, as shown in FIG. 3, is adjacently positioned to base 16.

Web 26 has a number of longitudinally spaced openings 32 of noncircular transverse cross section defined therein that slidably support a plurality of pins 34, also of noncircular transverse cross section. Each pin 34 supports a button 36 on the upper end thereof. A compressed helical spring 38 encircles each pin, with the lower end of the spring abutting against the web 26 and the upper end against a button 36, as shown in FIG. 3. Each pin 34 includes a stop 34*a* to prevent the compressed spring 38 moving the pin above a predetermined first position, as illustrated in FIG. 4.

Figure 3:
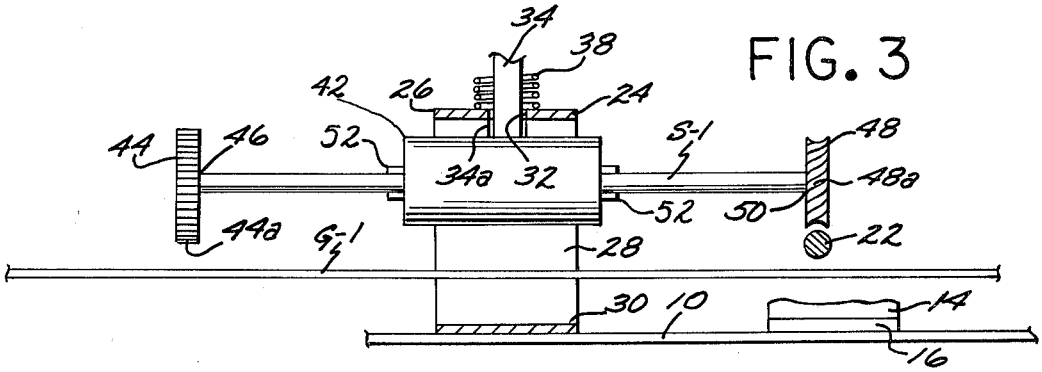
FIG. 3 is a side elevational view of the device shown in FIG. 2, with the power driven rotatable member in a first position.

Each pin 34 supports a bearing 42 on the lower end thereof, as shown in FIG. 3. The bearings 42 rotatably support shafts S-1 to S-6 that lie in planes common to the strings G-1 to G-6. The shafts S-1 to S-6 support circular members 44 on the first ends 46 thereof that are formed from a material such as felt, a polymerized resin or the like that causes a tensioned string to vibrate when the member is brought into rotating pressure contact therewith. Each circular member 44, as may be seen in FIGS. 1 and 4, is capable of being brought into rotating pressure contact with one of the tensioned strings G-1 to G-6. The circular members 44 are formed from a material softer than the material forming the strings G-1 and G-6 to prevent the strings being cut or abraded due to rotating pressure contact with the members 44.

Figure 4:
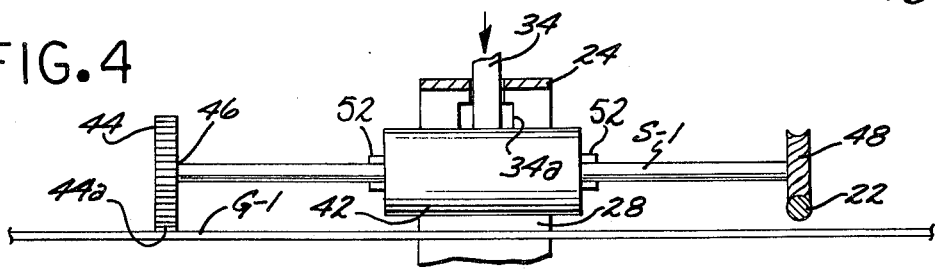
FIG. 4 is the same view illustrated in FIG. 3, but with one of the rotatable members in rotatable pressure contact with a string to cause the latter to vibrate and emit a musical tone.

The shafts S-1 to S-6 have gears 48 on second ends 50 thereof, which gears are capable of engaging the worm gear 22 when the pins 34 are in the second position shown in FIG. 4.

Each gear 48 is of such diameter that as the teeth 48*a* thereof initially engage the teeth 22*a* of worm gear 22, the lower extremity 44*a* of gear 44 is slightly spaced from one of the strings G-1 to G-6. When one of the gears 48 has the teeth 48*a* thereof in full engagement with teeth 22*a*, the rotatable member 44 associated with that particular gear has the extremity 44*a* thereof in rotatable pressure contact with one of the strings G-1 to G-6. It will be particularly noted that when one of the pins 34 is moved inwardly towards one of the strings G-1 to G-6, the rotatable circular member 44 associated with that particular pin is rotating prior to the pin being disposed in the second position illustrated in FIG. 4. Due to this prior rotation of each of the rotatable circular members 44 before the pin 34 associated therewith moves to the second position, no one of the strings G-1 to G-6 is ever contacted by a rotatable member 44 which is not rotating and causing the string to vibrate and emit a musical tone. The teeth 22*a* and 48*a* are of a substantial depth to permit continued movement of the rotatable members 44 towards the strings G-1 to G-6 to pressure contact the latter after there has been initial engagement between the teeth 22*a* and 48*a*.

The use and operation of the invention is extremely simple. The guitar B is played in a conventional manner except the fingers or a pick are not used to pluck the strings G-1 to G-6 or a group thereof. Instead, when one or a group of the strings G-1 to G-6 is desired to be vibrated to produce a particular musical effect, the buttons 36 associated with those strings are pressed inwardly to dispose a member 44 or group of members 44 in second positions where they cause vibrations of the selected strings. When manual pressure on a button 36 is released, the compressed helical spring 38 associated therewith moves the pin 34 encircled by the spring to a first position where the member 44 controlled by that pin is no longer in contact with one of the strings G-1 to G-6.

Each of the shafts S-1 to S-6 has a pair of collars 52 mounted thereon, as shown in FIG. 3, to prevent the shaft moving longitudinally relative to bearing 42.

Figure 5:
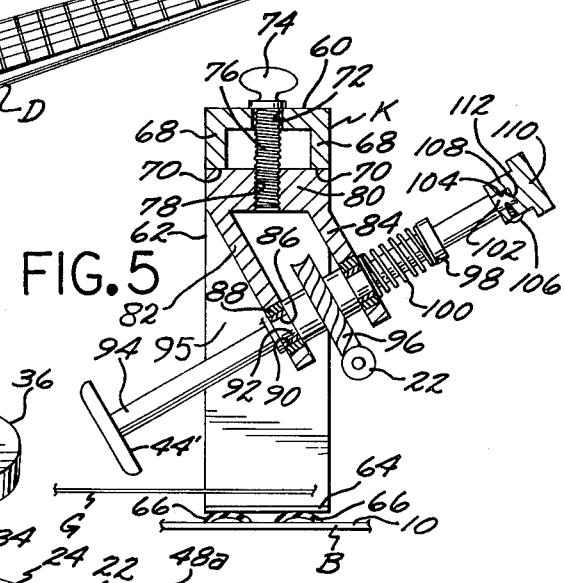
FIG. 5 is a combined side elevational and transverse cross sectional view of an alternate form of the device.
Figure 2:
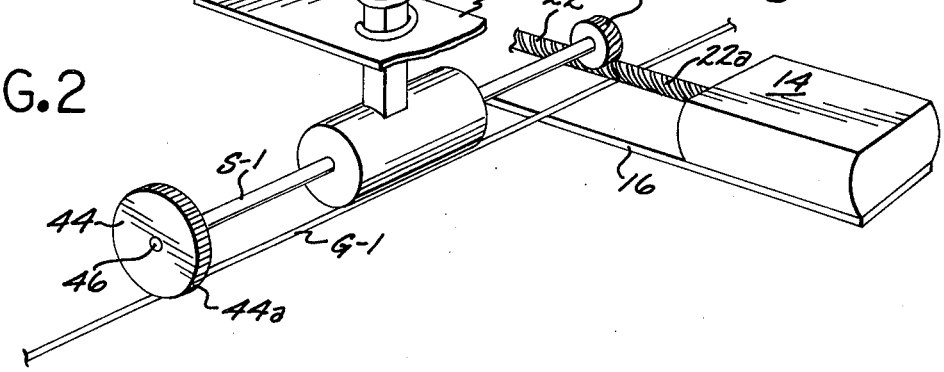
FIG. 2 is a perspective view of a portion of the power operated device.

An alternate form K of the invention is shown in FIG. 5 that is used in the same manner and produces the same results as the form A of the invention previously described. Alternate form K includes a rigid elongate member 60 that is transversely positioned above strings G of the guitar B. Member 60 has two legs 62 extending downwardly from the ends thereof. Legs 62 on the lower ends thereof develop into normally disposed tabs 64, which tabs are secured to the side 10 of the guitar B by vaccum cups 66 or other suitable fastening means. Member 60, between legs 62, has a pair of ribs 68 extending downwardly from the longitudinal edges thereof. The ribs 68 have lower edge surfaces 70.

Member 60 has a longitudinal slot 72 therein. A number of spaced thumb screws 74 have the threaded shanks 76 thereof extending downwardly through slot 72 to engage tapped bores 78 formed in rigid bodies 80. Each body 80, as may be seen in FIG. 5, has two angularly disposed parallel legs 82 and 84 depending therefrom.

Axially aligned openings 86 are formed in legs 82 and 84 that support first sleeves 88 having interior cylindrical surfaces that rotatably support second sleeves 90. The sleeves 90 have noncircular axially aligned bores 92 extending therethrough that slidably engage a shaft 94 of like transverse cross section. Each shaft 94 slidably engages a bore of noncircular cross section in a gear 96 that is disposed between the legs 82 and 84 and is in engagement with the worm gear 22 that is driven by motor 14 as previously described.

Each shaft 94 has first and second longitudinally spaced stops 95 and 98 thereon. A compressed helical spring 100 encircles shaft 94, with one end of the spring bearing against legs 84 and the other end against second stop 98. A first end portion 102 of shaft 94 is of cylindrical shape and has a circumferentially extending groove 104 therein that is slidably engaged by the inner end of a screw 106 mounted in a boss portion 108 of a button 110. The boss portion 108 has a cavity 112 therein that rotatably engages end portion 102. A second end 114 supports one of the circular members 44 by conventional means (not shown).

Each of the shafts 94 and the associated components above described is aligned with one of the strings G, with the thumb screw 74 associated with the shaft being rotated in an appropriate direction to move the body with which the thumb screw is in engagement upwardly into frictional binding contact with end surfaces 70. When one of the buttons 110 is pressed downwardly the rotating member 44 is brought into contact with one of the strings G to cause the latter to vibrate and emit a musical tone. When pressure is released from one of the buttons 110, the spring 100 expands and moves the rotating member to the first position illustrated in FIG. 5. It will be particularly noted in the alternate form of the invention K that each shaft 94 rotates concurrently with worm gear 22. Due to the thumb screws 74, the bodies may be so spaced as required on a particular guitar for the rotating members 44 to be moved into rotating contact with the strings G that form a part of the instrument.

Figure 6:
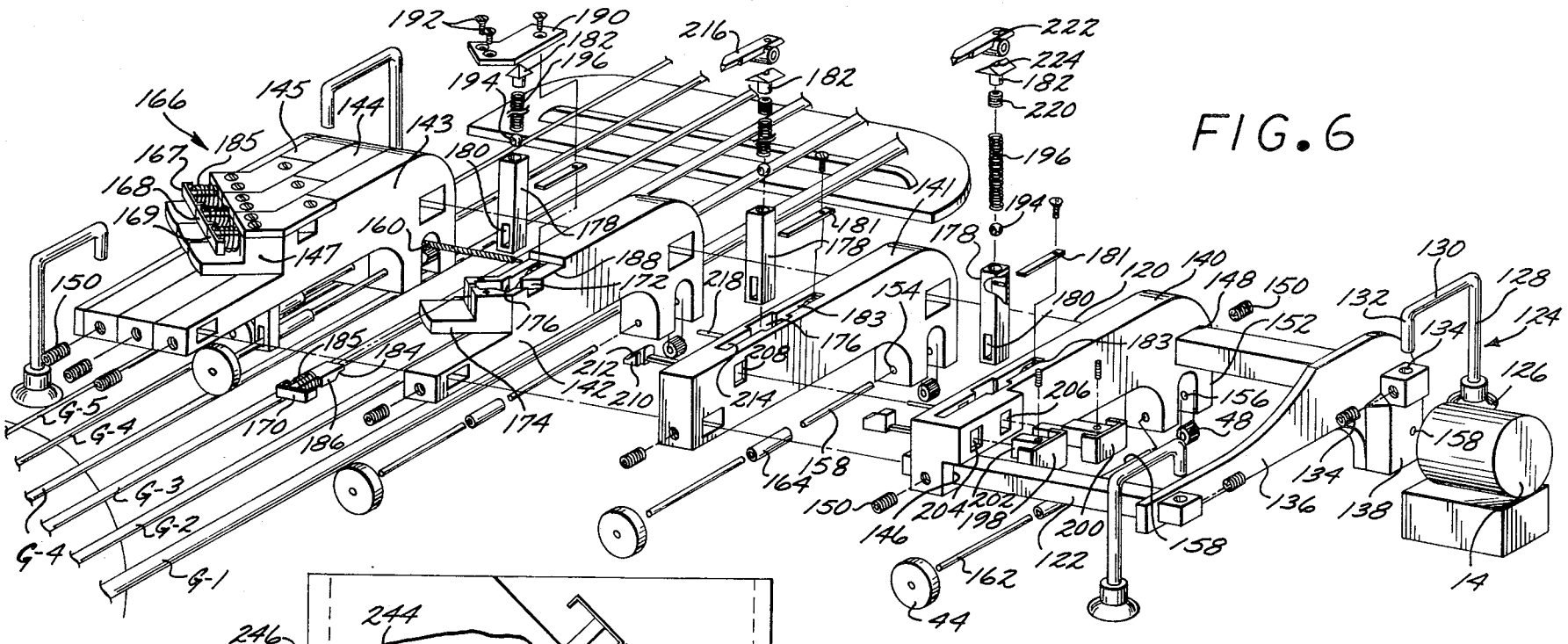
FIG. 6 is a perspective, exploded view of a device of the invention with adjustably spaced rotatable members.

Referring now to FIG. 6, an alternative embodiment of the invention is disclosed which provides for the fixed, lateral adjustability of the rotatable members and supporting structure, thereby accommodating to stringed instruments with widely varied string spacings. Additionally, the embodiment illustrated in FIG. 6 incorporates a number of preferred embodiments such as means for resiliently biasing the rotatable members against the strings and an angular, side-by-side array of the finger buttons, thereby adapting the device to the natural and relaxed finger positions.

The device as illustrated in FIG. 6 is formed by support means comprising at least one bar 120 and, preferably a second bar 122 that extends transversely of and overlies the strings G-1 through G-6 of the instrument. The bars 120 and 122 are removably secured to the instrument by suitable means such as the supports 124 formed of a base 126 that can incorporate attachment means such as a suction cup or the like to permit securing of the base to the flat, playing surface of the instrument. The supports 124 also include a generally upright arm 128, a horizontal arm 130 and a downwardly dependent arm 132 which is secured in a distal bore 134 of the transverse bars 120 and 122. The arms 128 and 130 can be of telescopic construction to provide for fixed adjustability of the positioning of the support 124 on the playing surface of the instrument. The supports 124 are firmly secured to transverse bars 120 and 122 by suitable means such as set screw 134 that extends through a threaded bore into contact with the arm 132 of these support members.

The device can be provided with an end plate member 136 having a transverse arm with distal apertures for receiving each of the bars 120 and 122. This member can have a base 138 to rest on the playing surface of the instrument and provide additional support to the device. The device also includes the motor 14 for rotating the rotatable members as hereinafter described and base 138 is bored at 158 to receive the drive shaft from motor 14.

Slidably carried on bars 120 and 122 are a plurality of receptacle means in the form of transverse arm members 140–145. Each of these arm members has distal apertures 146 and 148 for receiving bars 120 and 122 whereby each of the arm members is carried in the assembly in a laterally sliding attachment. Means are provided for the fixed lateral adjustability of the arm members such as set screws 150 which extend through threaded bores that intersect the distal apertures 146 and 148 and project into binding engagement with the bars 120 and 122.

Each of the arm members 140–145 carries a downwardly dependent channel section 152 with axially aligned bores 154 and 156 extending through the side walls of the channel sections. Each of a plurality of rotatable shafts 158 is rotatably supported in the axially aligned bores 154 and 156 and a gear 48 is carried on each of shafts 158 within the open channel of the channel sections 152. The drive shaft of motor 14 extends through aperture 158 in base 138 of the end plate 136 and is secured to the worm gear 160 (shown to the left of FIG. 6) which engages each of the gears 48 in a driving relationship whereby shafts 158 can be rotated by motor 14.

Rotatable members 44 are carried on the ends of stub shafts 162 which are coupled to the driven shafts 158 by universal coupling means such as resilient and flexible couplings 164. These couplings can be formed of rubber or plastic tubing and the like to permit a limited degree of vertical and/or lateral movement of stub shafts 162 while, nevertheless, permitting free rotation of rotatable members 44.

The arm members 140–145 carry a plurality of buttons, one each for each of rotatable members 44, and suitable actuating means for effecting movement of the rotatable members 44 into and out of contact with respective ones of strings G-1 through G-6. In the preferred embodiment, four buttons are positioned in a side-by-side array that is angularly oriented to the assembly. This is shown as button array 166 formed of buttons 167 through 170 which are slidably received in slots 172 in the top surface of arm members 142 through 145. Each arm member has an angularly offset abutment 147 and slots 172 are coextensive with the abutments 147. The slots 172 and abutments 147 are provided at an included angle to the longitudinal axis of the arm members which is from 10° to about 45°, preferably about 30°, thereby locating buttons 167–170 in the relaxed position of the fingers of a player of the instrument.

Preferably, each of arms 142–145 also carries a platform 174 as an extension of slot 172, thereby providing a rest for a player's fingers.

Each of arms 142–144 also has a transverse upright through passageway 176 that is, preferably, of a noncircular cross section. This passageway extends into intersection with the inclined slot 172 and slidably receives a tubular pin member 178. Each tubular pin member 178 has a distal, transverse slot 180 for receiving and rotatably supporting stub shafts 162. The upper end of pin 178 carries a wedge shaped cam 182 which is engaged by the downwardly, inclined face 184 of its respective arm 186 that is secured to button 170.

The upper surface of each of arms 142–145 is undercut as shown at 188 to receive a cover plate 190 which overlies slot 176, enclosing the actuating mechanism. Plate 190 is secured in the assembly by screw fasteners 192.

The rotatable members 44 are provided with a resilient interconnection to buttons 167–170. To this end, tubular pins 178 receive bearing means 194 in the form of a sphere bearing a transverse bore for receiving stub shafts 162. Resilient means in the form of a conventional, compression spring 196 is positioned between the upper surface of bearing 194 and the undersurface of cam 182. Slot 180 at the lower end of pin 178 is elongated to provide for a limited vertical displacement of stub shaft 162 whereby this shaft can be resiliently biased by spring 196.

At least one and, preferably, two arm members such as 140 and 141 are provided with laterally spaced actuating buttons 198 and 200 which are preferably substantially directly opposite from the side-by-side array of arms 141–145. These arms are provided with through passageways 176 similar to that previously described for receiving the tubular pins such as 178, also previously described. Each tubular pin has the aforementioned elongated distal slot 180 and receives bearing 194 and resilient means such as compressed spring 196 bearing against the upper cam 182.

Buttons 198 and 200 are mechanically connected in actuating relationship to pins 178 whereby pins 178 can be moved vertically in response to lateral movement of buttons 198 and 200. To this end, each button has a shank portion 202 slidably received in a transverse slot such as 204 and 206 of the arm member 140 and slot 208 of arm member 141, the latter slot being coaxial with slot 206 to receive the shank of button 200. The shank 202 of each of buttons 198 and 200 distally carry cam blocks 210 having an inclined upper face 212.

The forward medial portions of arms 140 and 141 bear a transverse slot such as 214 which intersects the through passageway 176 to provide a chamber in which cam blocks 210 are received. Also received within each chamber defined by slots 214 is an actuating lever mechanism comprising lever arm 216 that is pivotally carried on pin 218 and that has a forward end bearing against inclined face 212 of block 210 and a rear face that bears against the upper surface of cam 182, thereby transferring the lateral reciprocal movement of buttons 198 and 200 to the reciprocal vertical movement of pins 178.

The buttons are resiliently biased into a retracted position by a plurality of spring means such as 185 each associated with a respective one of the plurality of buttons to permit the pins 178 to move to their uppermost position, retracting rotatable members 44 from the springs of the instrument. Springs 185 are coaxial with the shaft 171 and are biased between the rear face of the button of each button assembly, bearing against the face of its respective abutment 147. Leaf springs 181 are mounted in a slot 183 of each arm member and resiliently bear against the undersurface of cam 182 to bias pins 178 upwardly, raising rotatable members 44 from the strings.

In the preferred embodiment, the tension of the resilient means 196 for biasing the rotatable members 44 on the strings is fixedly adjustable. To this end, the cam 182 can be provided with adjustment means such as set screw 220 which is engaged in the internal threads of the shank of cam 182 such that rotation of set screw 220 will advance or retract the set screw in the shank of the cam 182. The undersurface of set screw 220 is the retaining surface for spring 196 so that advancing or retracting set screw 220 in cam 182 can provide variable tensioning of the resilient means 196. The set screw can be provided for external adjustment by bores 222 and 224 which are coaxial with the set screw and which permit insertion of a tool such as an Allen wrench or the like into engagement with the received head of the set screw 220.

Figure 7:
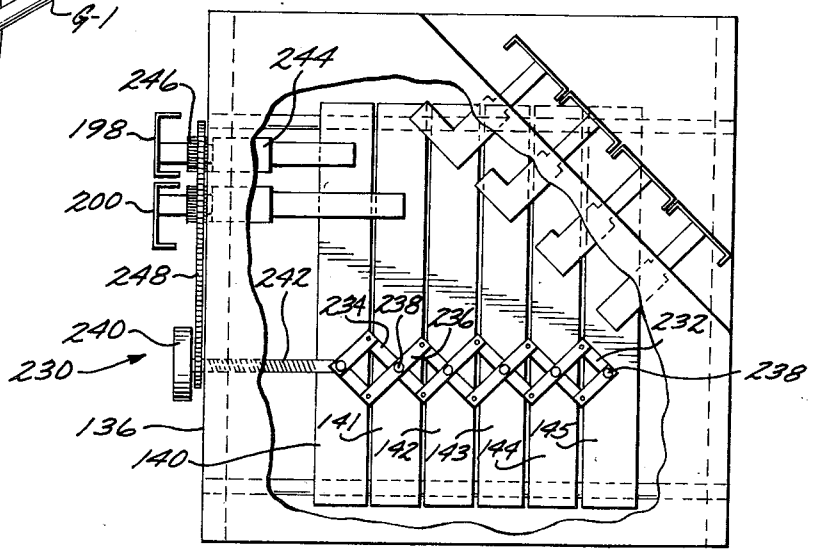
FIG. 7 is a plan view of a device of the invention in which the rotatable members are adjustably spaced in a proportional manner.

Referring now to FIG. 7, there is illustrated an embodiment of the invention which provides for proportional and equal spacing of the arm members 140–145. The construction of the device shown in FIG. 7 is substantially the same as that of FIG. 6 with the exception of the proportionating mechanism generally indicated at 230. As there illustrated, the arm members 140–145 are mechanically interconnected by the lazy tongs mechanism 232 that is formed of a plurality of pairs of link arms 234 and 236 which are pivotally interconnected at their mid-portions by pins 238. The pins 238 are also secured to each of the arm members 140–145. In this manner, movement of any of the arm members will effect a proportionate movement of the remainder of the members.

If desired, the device can be provided with a mechanical drive for effecting lateral movement of the arm members 140–145. This is illustrated by knob 240 which is carried by lead screw 242 and which is threadably engaged in a threaded bore in side plate 136 or in a nut member carried thereon. The inboard end of lead screw 242 is pinned to the lazy tongs assembly 230 such that rotation of thumb screw 24 will expand or contract the lazy tongs assembly, effecting proportional lateral displacement of each of the arm members 140–145.

The actuating mechanism for buttons 198 and 200 is preferably provided with a telescopic extension such as 244 which extend to blocks 210 as shown in FIG. 6 to permit the extension or retraction of the actuating mechanism as the arm members 140 and 141 are laterally displaced. Preferably, this telescoping action is effected in a driven manner by rotatable shaft extensions that engage internal threads of coupling 244. This can be effected by gears 246 on the shafts of each of the extensions from buttons 198 and 200 which extend to blocks 210 (see FIG. 6). The gears can be interconnected by suitable drive means 248 such as a gear train and the like so as to be mechanically interconnected with knob 240 and lead screw 242.

The invention has been described with reference to the presently preferred and illustrated embodiment thereof. It is not intended that the invention be unduly limited by this description of preferred embodiments. Instead, it is intended that the invention be defined by the means and their obvious equivalents set forth in the following claims.

What is claimed is:

1. In combination with a musical stringed instrument that includes a rigid body bearing an elongate keyboard, a bridge secured to a first side of said body, and a plurality of laterally spaced tensioned strings that extend longitudinally the length of said keyboard and across said bridge, and means on said keyboard and body for engaging end portions of said strings to maintain the latter in a tensioned condition, power operated means for selectively vibrating each of said strings individually or in unison with other of said strings, said power operated means including:

a. a plurality of laterally spaced, elongate shafts that are spaced from said strings and substantially parallel thereto, with each of said shafts including first and second ends;

b. a plurality of rotatable members mounted on said first ends of said shafts that cause said strings to vibrate and emit a musical tone when brought into rotatable pressure contact therewith;

c. power means for rotating said shafts; and d. manually actuated means for selectively moving said shafts and rotatable members from first positions where said rotatable members are out of contact with said strings to second positions where said rotatable members are in rotatable pressure contact with said strings to cause the latter to vibrate and emit musical tones, said manually actuated means including a support means extending transversely across said strings and secured to said first side, said support means carrying receptacle means to slidably receive a plurality of pins; a plurality of pins slidably mounted in said receptacle means, said pins having first and second ends; a plurality of buttons mounted on said support means and bearing on the first ends of said pins; a plurality of bearings mounted on said second ends of said pins that rotatably support said shafts; and spring means that at all times tend to maintain said buttons, pins, shafts, rotatable members and gears in said first position, but each of said rotatable members being selectively movable to said second position by applying manual pressure to said button associated therewith.

2. The combination as defined in claim 1 in which said power means for rotating said shafts includes:

e. an electric motor disposed at a fixed position relative to said first side of said body;

f. a worm gear driven by said motor and extending transversely across said strings; and g. a plurality of gears rigidly secured to said second ends of said shafts, with said gears being in contact with said worm gear at least when said shafts and rotatable members are in said second positions.

3. The combination as defined in claim 2 in which said gears are out of engagement with said worm gear when said shafts and rotatable members are in said first position.

4. The combination as defined in claim 2 in which said manually actuated means includes:

h. an inverted channel-shaped member as said support means and extending transversely across said strings and secured to said first side, said channel-shaped member including an elongate web and bearing a plurality of spaced openings normally aligned relative to said strings as said receptacle means;

i. said plurality of pins of non-circular transverse cross section slidably mounted in said openings; and j. said plurality of buttons mounted on said first ends of said pins;

5. The combination as defined in claim 4 in which said spring means are a plurality of compressed helical springs that encircle said pins, with said springs being in abutting contact with said buttons and said web.

6. The combination as defined in claim 1 wherein said support means comprises at least one bar member extending transversely across said strings and secured to said first side and wherein said receptacle means comprises a plurality of arm members slidably carried on said bar member with means to fixedly secure said arm members thereto.

7. The combination as defined in claim 6 wherein said buttons are slidably carried on said arm members.

8. The combination as defined in claim 7 wherein each of said arm members bear slot means at an inclined angle to its longitudinal axis to receive said buttons.

9. The combination as defined in claim 8 wherein a plurality of adjacent arm members bear said slots to provide an angularly offset row of said buttons.

10. The combination of claim 1 wherein at least one of said arms bear a transverse slot to slidably receive a button and carries lever means extending from said button to the first end of its respective pin.

11. The combination of claim 1 wherein said second ends of said pins resiliently support said shafts.

12. The combination of claim 11 wherein said pins are slotted at their second ends to receive said shafts and support longitudinal springs to provide said resilient support of said shafts.

13. The combination of claim 12 wherein said pins are tubular to receive said longitudinal springs.

14. The combination of claim 6 wherein said arm members are mechanically coupled by lateral spacing means to effect proportional lateral movement of said arm members and thereby maintain equal and variable spacing between said arm members.

15. A power actuated resonator for a musical stringed instrument which comprises:

a support means for mounting on the instrument to extend transversely across the strings thereof;

a plurality of laterally spaced, elongate shafts carried on said support means substantially parallel to and spaced apart from said strings and a like plurality of stub shafts, one each for each of said elongate shafts;

a plurlaity of universal couplings, one each flexibly interconnecting a pair of elongate and stub shafts;

power means to rotate said shafts;

a plurality of buttons carried by said support means in a plane substantially parallel to said strings and in a side-by-side array at an inclined orientation to said strings with an inclined angle to said strings to 10° to about 45°, approximately the relaxed finger position of a player of the musical instrument;

a plurality of rotatable members mounted on like ends of said stub shafts perpendicular to said strings and in a side-by-side array at the same inclined orientation of said buttons;

means interconnecting said buttons to respective one of said rotatable members to effect selective movement of said rotatable members into contact with respective ones of said strings; and spring means that at all times tend to maintain said buttons and rotatable members out of contact with said strings.

16. The resonator as defined in claim 15 also including at least one button laterally carried by said support means and operative to effect selective movement of its respective one of said rotatable members.

17. The resonator of claim 16 including four buttons in said side-by-side array and two buttons laterally carried by said support means.

18. In combination with a guitar that includes a body from which a keyboard extends, said body including a first side to which a bridge is secured, a plurality of tensioned laterally spaced strings that extend longitudinally the length of said keyboard and across said bridge, and means on said keyboard and body for engaging end portions of said strings to maintain the latter in a tensioned condition, power operated means for selectively vibrating each of said strings individually or in unison with others of said strings, to emit musical tones, said power operated means including:

a. a worm gear that extends transversely across said strings and spaced therefrom;

b. a first means for rotatably supporting said worm gear at a fixed position relative to said first side;

c. second means for rotating said worm gear;

d. an elongate rigid member that is disposed above said strings and extends transversely thereacross, said member having an elongate slot therein;

e. third means for holding said elongate member at a fixed position relative to said first side;

f. a plurality of thumb screws that have threaded shanks that extend through said slot towards said first side;

g. a plurality of bodies disposed between said first side and elongate member, said bodies having tapped bores therein that engage said threaded shanks;

h. a plurality of gears that engage said worm gear, each of said gears having a bore of non-circular transverse cross section extending transversely therethrough, each of said gears disposed between one of said bodies and said first surface;

i. a plurality of elongate shafts disposed parallel to said strings, each of said shafts including a section of non-circular transverse cross section that slidably engages one of said bores;

j. bearing means for rotatably and slidably supporting said shafts from said bodies;

k. a plurality of buttons mounted on first outwardly disposed ends of said shafts;

l. a plurality of rotatable members mounted on second ends of said shafts;

m. a plurality of stops mounted on said shafts that contact said bearing means when said shafts are in first positions;

n. spring means that at all times tend to maintain said shafts in said first position; and o. a plurality of rotatable members rigidly secured to second ends of said shafts, said rotatable members of such diameter as to not contact said strings when said shafts are in said first position, but said rotatable members pressure contacting said strings to cause the latter to vibrate when said shafts are rotated and moved to second positions by manual pressure applied to said buttons, with said thumb screws by being loosened and tightened permitting said bodies associated therewith to be moved and removably held at positions on said elongate member where said shafts are disposed in planes normal to said first side and common to said strings.

* * * * *